US006149327A

United States Patent [19]

Ward et al.

[11] Patent Number: 6,149,327

[45] Date of Patent: Nov. 21, 2000

[54] METHOD AND APPARATUS FOR DETERMINING AND CONTROLLING INKJET PRINTING DRYING TIME

[75] Inventors: Jefferson P. Ward, Brush Prairie; Thomas W. Ruhe, La Center; Thomas E. McCue, Jr., Vancouver, all of Wash.

[73] Assignee: Hewlett-Packard Company, Palo Alto, Calif.

[21] Appl. No.: 09/470,109

[22] Filed: Dec. 22, 1999

[51] Int. Cl.[7] ..... B41J 11/42

[52] U.S. Cl. ..... 400/582; 400/76; 400/70; 400/61

[58] Field of Search ..... 347/101, 102; 400/582, 76, 70, 61

[56] References Cited

U.S. PATENT DOCUMENTS

| | | | |
|---|---|---|---|
| 4,469,026 | 9/1984 | Irwin | 101/426 |
| 5,428,379 | 6/1995 | Kaneko et al. . | |
| 5,631,685 | 5/1997 | Gooray et al. | 347/102 |
| 5,655,174 | 8/1997 | Hirst . | |
| 5,714,990 | 2/1998 | Courtney | 347/14 |
| 5,771,054 | 6/1998 | Dudek et al. | 347/102 |

FOREIGN PATENT DOCUMENTS

| | | |
|---|---|---|
| 08267846 | 10/1996 | Japan . |
| WO98/52762 | 11/1998 | WIPO . |

*Primary Examiner*—John S. Hilten
*Assistant Examiner*—Charles H. Nolan, Jr.

[57] ABSTRACT

Print media drying time need not be set to an artificially high "worst case" drying time. Instead a reliable drying time is estimated based upon factors, such as temperature, humidity, media type, print quality and ink drop volume. When the estimated drying time is undesirably slow, the estimated and actual drying time is reduced by altering the ink composition of the image to be printed. One technique is to over-print or under-print with composite black rather than a true pigment black. Another technique is to deplete the black ink used throughout the image.

24 Claims, 5 Drawing Sheets

FIG. 4
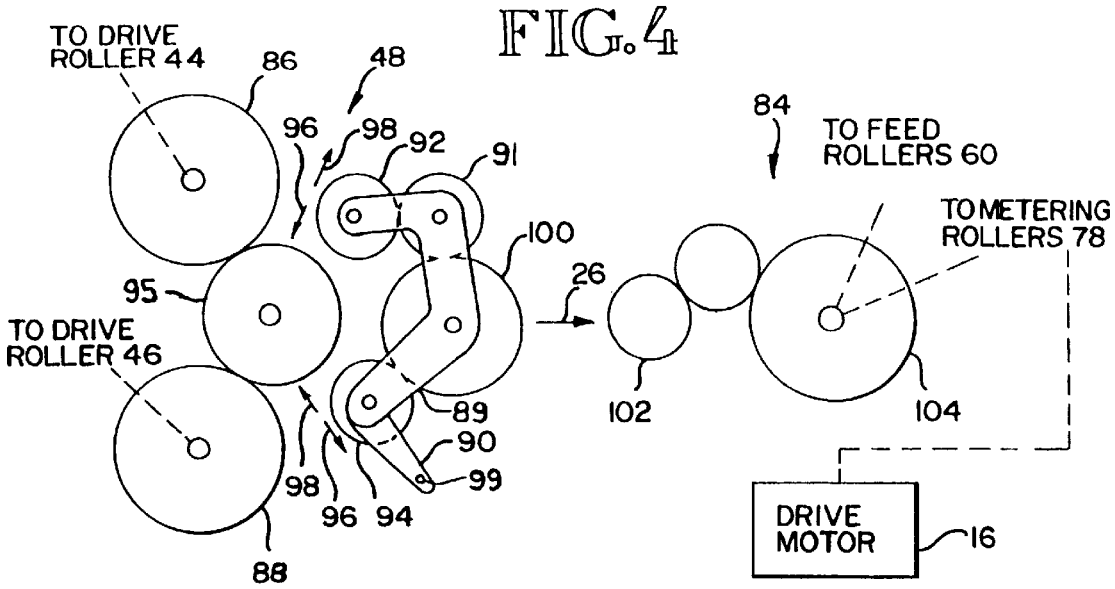
FIG. 5
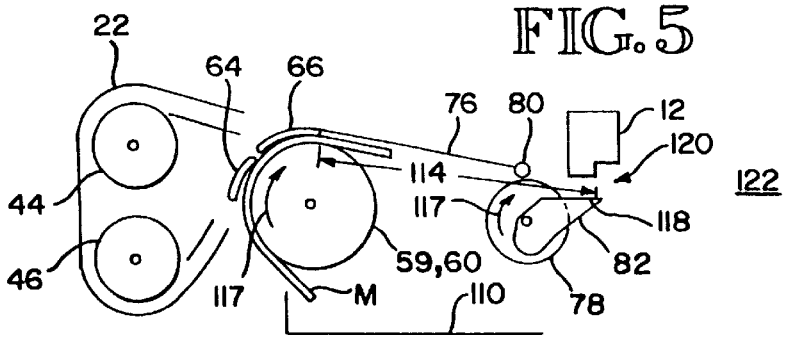
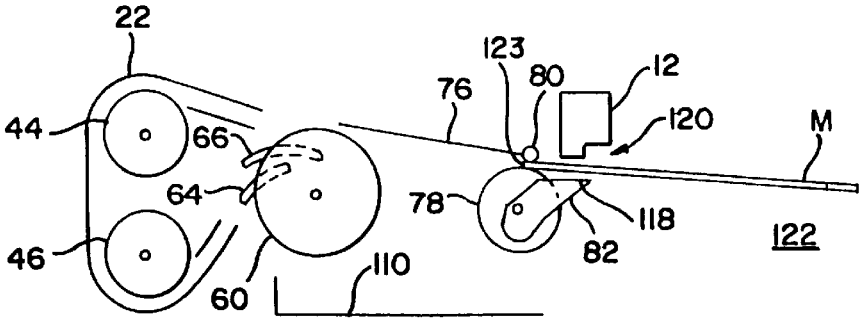
FIG. 6

METHOD AND APPARATUS FOR DETERMINING AND CONTROLLING INKJET PRINTING DRYING TIME

BACKGROUND OF THE INVENTION

This invention relates generally to methods and apparatus for printing on a media sheet using inkjet printing techniques, and more particularly, to a system in which media sheet drying time is estimated and adjusted.

Inkjet printing techniques involve the ejection of drops of liquid ink onto a media sheet to form symbols, characters or graphics. Upon completion of printing, the ink on the media sheet typically is wet. Before the media sheet can be handled, folded or re-fed into a paper path, and before a media sheet can be laid over the wet media sheet, the media sheet must be dry enough to avoid ink smearing.

As faster printing speeds and duplex printing become more desired, the wet media problem becomes more significant and costly. One approach has been to utilize a dye that penetrates the paper fibers and is less susceptible to smearing. Shortcomings of this approach include, feathering along region edges, decreasing in the optical density due to paper fibers reflecting more incident light.

Another approach to achieve higher printing speeds has been to include a one-sheet buffer area. The buffer is formed by output rails. When a media sheet is printed, it is moved along output rails where it is suspended above an output tray. By doing so, the top sheet in the underlying output stack is given additional time to dry. When the next sheet is printed, the prior sheet is dropped onto the output stack giving it additional time to dry. However, as the desire for still faster printing speeds continues, and as the desire for duplex printing manifests, additional techniques are needed.

SUMMARY OF THE INVENTION

According to the invention, there are multiple inkjet drying time look-up tables stored in memory which estimate inkjet media drying time. Various inputs are detected to determine and look up an estimated drying time. Such estimate is used as an riate drying time for a current media sheet or print job.

According to various steps of a preferred embodiment, several user-selectable print controls are polled, including media type, desired print quality, and duplex/. simplex printing mode. Different media require different drying times. For differing print quality, such as best, normal or draft, the ink density and correspondingly, ink drying time will vary. For duplex printing, the just printed media sheet typically is to be fed back onto a media path for second-side printing. However, the first side needs time to dry before the media sheet is fed back.

According to another step of a preferred embodiment, the humidity and temperature of the printing environment is detected. Both humidity and temperature also impact the drying time. Further, in some embodiments ink drop volume is identified as a factor in estimating media sheet drying time.

Based on the inputs, an estimated drying time is either calculated or looked up from a drying time table. Improvements in drying time are particularly desirable for media sheets having the longest drying times, (e.g., pigment text printing).

According to an aspect of the invention, drying time is reduced by under-printing or over-printing black at various portions of the image to be printed. In particular, a desired black tone on an image is formed by using more composite black. It is known that black can be generated using a black pigment ink (e.g., true black). It also is known to generate black as a composite black by combining the other ink pigments (e.g., cyan, magenta and yellow—CYM). To reduce drying time the amount of pigment black and composite black may be altered to include more composite black and less pigment black for a desired black tone. The pigment black generates a truer black tone than the composite black. Thus, how black the desired black tone appears in effect is traded off to decrease the drying time. This may be acceptable, for example, during draft or normal print quality modes.

In brief where the media sheet will not dry within an acceptable time, the print commands will be varied to format the image using an increased amount of CMY composite blacks and a reduced amount of black pigment ink. The type of media also is a factor in determining how and when it is effective to substitute CMY composite blacks for pigment black. For example, on a glossy-coated media sheet, the CMY composite blacks more closely resemble true black than for a standard copy paper media sheet.

Even when printing colored tones (e.g., non-black) of an image, it is common to include a percentage of black pigment ink to form the desired color. According to another aspect of the invention, the amount of black ink used for such colored areas or all areas of the image may be reduced. This is referred to herein as depleting the amount of black pigment ink used.

According to an advantage of this invention, print media drying time need not be set to an artificially high "worst case" drying time. Instead a reliable drying time can be estimated based upon factors, such as temperature, humidity, media type, print quality and ink drop volume. According to another advantage of the invention, when the estimated drying time is undesirably slow, the estimated and actual drying time is reduced by altering the ink composition of the image to be printed (e.g., using over-printing and under-printing with composite black; by using black ink depletion techniques). These and other aspects and advantages of the invention will be better understood by reference to the following detailed description taken in conjunction with the accompanying drawings.

BRIEF DESCRIPTION OF THE DRAWINGS

FIG. 4 is a diagram of the duplex media handling system transmission and the simplex media handling system gear linkage of FIG. 3;

FIG. 5 is a diagram of the duplex media handling system and simplex media handing system during the pick and feed of a media sheet;

FIG. 6 is a diagram of the duplex media handling system and simplex media handing system at the completion of first side printing where the rollers are stopped with the media sheet trailing edge gripped by the metering rollers;

DESCRIPTION OF SPECIFIC EMBODIMENTS

Overview

Figure 1:
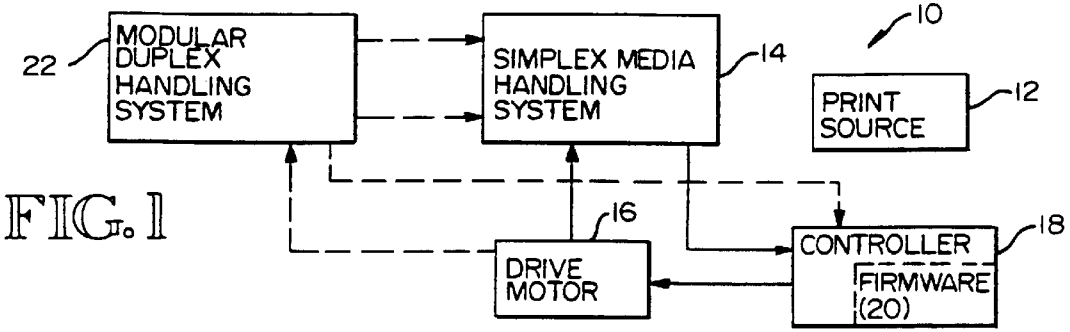
FIG. 1 is a block diagram of a print recording system.
Figure 2:
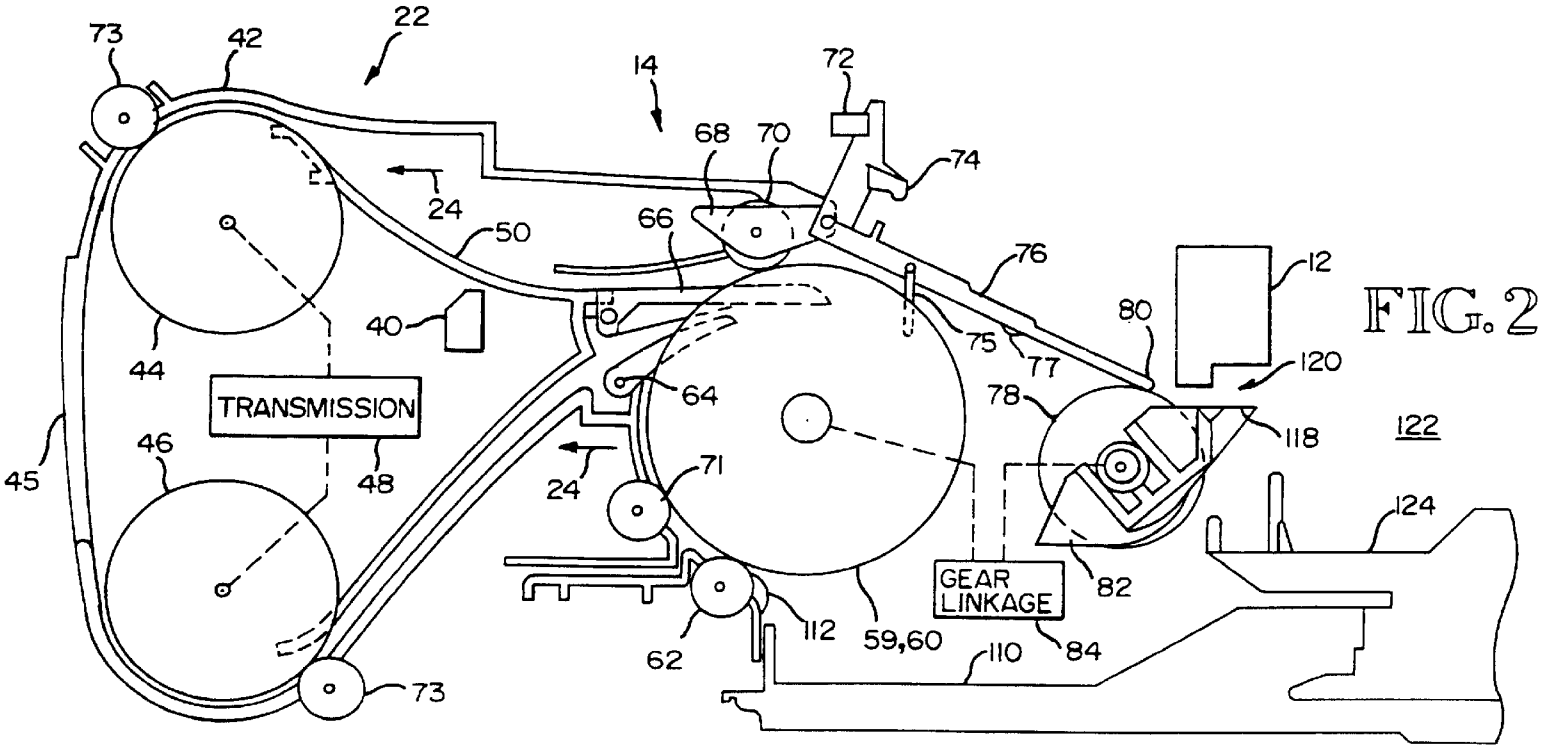
FIG. 2 is a planar view of a portion of a simplex media handling system and modular duplex handling system of FIG. 1.
Figure 3:
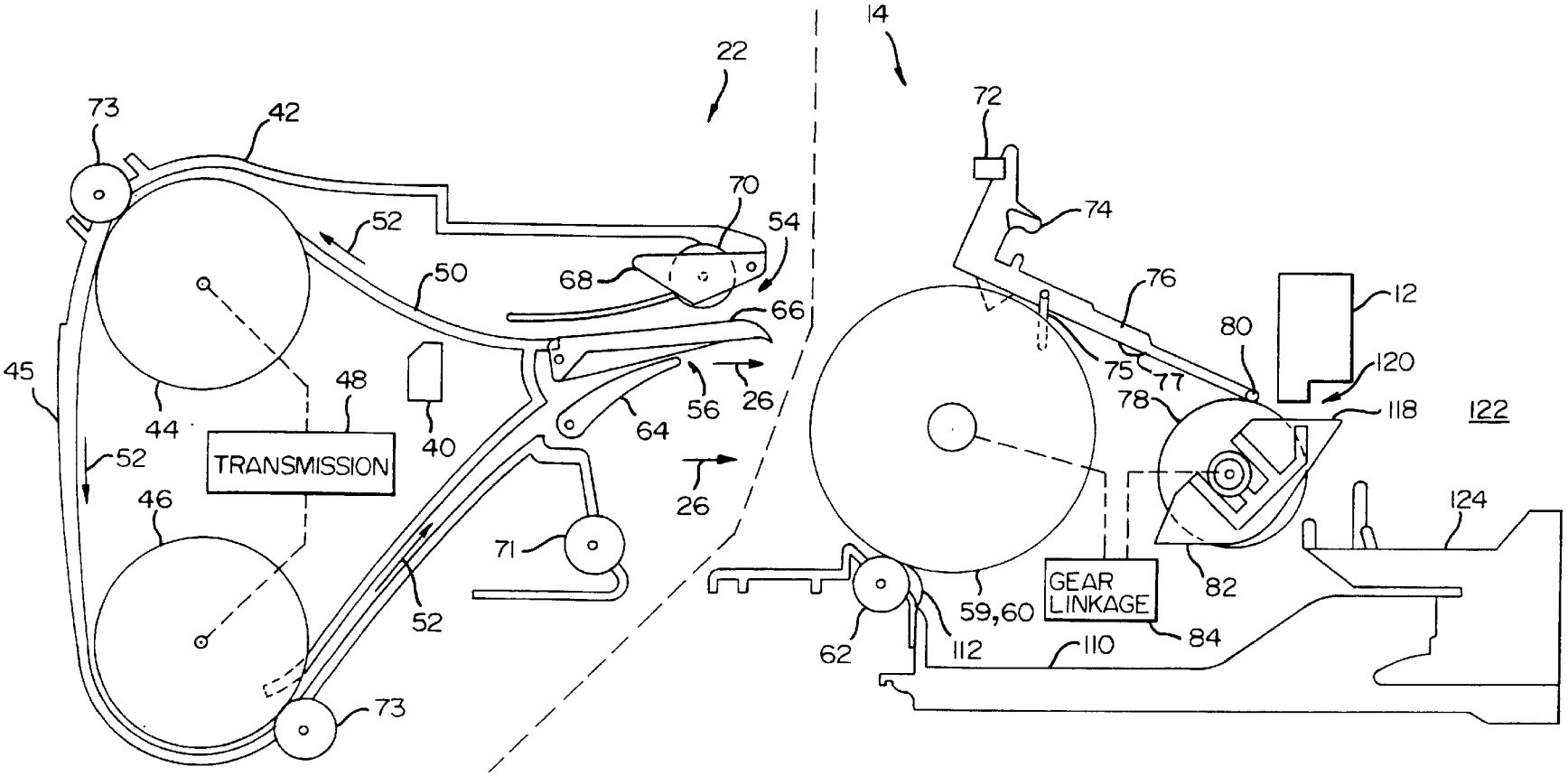
FIG. 3 is an exploded planar view of the duplex handling system separated from the simplex handling system of FIG. 2.

Referring to FIG. 1, a print recording system 10 includes a print source 12, a simplex media handling system 14, a drive motor 16 and a controller 18 with firmware 20. In some embodiments the system 10 also includes a modular duplex media handling system 22. Referring to FIG. 2, the print source 12, simplex media handling system 14 and duplex media handling system 22 are shown for an inkjet printer embodiment. FIG. 3 shows the same structure with the duplex handling system 22 detached. In one embodiment the duplex media handling system 22 is easily removed by sliding the module 22 in direction 24 (see FIG. 2), then lifting the module away from the simplex media handling system 14. The duplex media handling system 22 is installed by removing a rear access door, then lowering the system 22 into a housing for the print recording system 10. The duplex media handling system 22 then is slid in direction 26 (see FIG. 3) toward the simplex media handling system 14.

The duplex media handling system 22 includes a sensor 40 which interfaces with the controller 18, allowing the controller 18 to detect whether the duplex media handling system 22 is present in the print recording system 10. If the sensor 40 signal indicates that the duplex media handling system 22 is not present, then the controller 18 firmware 20 disables duplex printing operations and allows simplex printing operations.

In operation the print recording system 10, receives a media sheet upon which text, graphics or other symbols are to be recorded. For example, in an inkjet printer embodiment the printer receives a print job from a host computer (not shown). The controller 18 controls the drive motor 16 and print source 12 coordinating the movement of the media sheet relative to the print source 12. For single-sided (i.e., simplex) printing, the media sheet is fed through the simplex media handling system 14 adjacent to the print source 12 where the text, graphics or other symbols are recorded on the media sheet. For embodiments including the duplex media handling system, the media sheet is fed through the simplex media handling system 14 along a media path to perform first-side printing. For duplex printing, the media sheet then is fed back along a portion of the media path into the duplex handling system 22 which flips the media sheet, then returns the media sheet to the simplex media handling system 14 for second side printing.

Referring to FIG. 3, the duplex media handling system 22 includes the sensor 40, a frame 42, a pair of drive rollers 44, 46, a transmission 48, flip guides 64, 66, pinch rollers 70, 71, 73, and roller sleds 68. The transmission 48 is coupled to the print recording system's drive motor 16. During duplex printing, a media sheet is fed within the duplex media handling system 22 along a loop media path 52. The media sheet is received at flip guide 66 and fed by the simplex media handling system 14 along a paper guide 50 of the frame 42 toward the first drive roller 44. The drive roller 44 moves the media sheet along the path 52 to the second drive roller 46, which in turn, moves the media sheet out of the modular duplex handling system 22 back to the simplex media handling system 14. The duplex module media path 52 is a loop having an entry point 54 in the vicinity of the exit point 56. Both the entry point 54 and the exit point 56 are adjacent to a common area of the simplex media handling system 14.

Referring to FIGS. 2 and 3, the simplex media handling system 14 includes pick roller 59, feed rollers 60, feed idlers 62, a media sensor 72, flag 74, secondary flag 75, an upper guide 76, and metering rollers 78 with another set of pinch rollers 80, a pivot mechanism 82 and gear linkage 84. The drive motor 16 (see FIG. 1) is coupled to the feed rollers 60 and metering rollers 78 through the gear linkage 84. An opening is included for receiving the duplex media handling system 22.

Referring to FIG. 4, the gear linkage 84 of the simplex media handling system 14 is coupled to the transmission 48 of the duplex media handling system. The transmission 48 and gear linkage 84 couple the drive rollers 44, 46 to the drive motor 16. The transmission 48 includes a first drive gear 86 for the first drive roller 44 and a second drive gear 88 for the second drive roller 46. Through a subset of gears 86, 88, 91,92, 94, 95, and 100, the transmission 48 engages the drive rollers 44, 46.

Gear 100 serves as a coupling gear which links the transmission 48 to the gear linkage 84 of the simplex media handling system (e.g., at gear 102). Gear 100 is driven by the drive motor 16 through the gear linkage 84. Transmission gears 91, 92, and 94 are coupled to gear 100, and are mounted to a gear mount 89. The rotation of gear 100 causes the gears 91, 92 and 94 and gear mount 89 to move about the gear 100 in one of two directions 96, 98. Movement of the gears 91, 92, 94 in direction 96 brings gear 92 into engagement with gear 95, and gear 94 out of engagement with gear 95, causing drive gears 86, 88 to rotate in the opposite direction. In this engagement of gears 92 and 95, the transmission 48 is considered to be in first gear. Movement of the gears 91,92, 94 in direction 98 brings gear 94 into engagement with gear 95, and gear 92 out of engagement with gear 95, causing drive gears 86, 88 to rotate in one direction. In this engagement of gears 94 and 95, the transmission 48 is considered to be in second gear. In first gear, the drive rollers 44, 46 rotate in the same direction as the feed rollers 60 and metering rollers 78 of the simplex media handling system. In second gear, the drive rollers 44, 46 rotate in the opposite direction as the feed rollers 60 and metering rollers 78 of the simplex media handling system.

When the duplex media handling system is installed, gear 100 engages the gear linkage 84 of the simplex media handling system 14 at an interface gear 102. Gear linkage 84 also includes a drive gear 104 which is coupled to the drive motor 16 through a linkage included to drive the feed rollers 60 and metering rollers 78.

The transmission 48 also includes a clutch 90 which is coupled at one end to gear 94. The other end of the clutch 90 includes a protrusion 99 which moves within a cam track (not 30 shown). When the transmission 48 is in neutral, the protrusion 99 sits in a fixed location (e.g., a V-lock groove) of the cam track. It takes a change of direction of gear 100 to move the protrusion out of the V-lock. A gear change (one of gears 92, 94 engaging gear 95) may then occur. Note that the clutch 90 moves with gear 94 in the directions 96,98. When gear 92 is engaged or gear 94 is engaged, the protrusion 99 does not come to rest in the V-lock. It is when the transmission 48 is in neutral, that the protrusion 99 sits in the V-lock.

To switch gears from engagement of gear 94 with gear 95 to neutral (the position illustrated in FIG. 4), the drive motor 16 stops driving gear 100, then restarts driving gear 100 in the opposite direction. This moves the gear 94 in direction 96 and brings the clutch 90 to rest in neutral (protrusion 99 sits in the V-lock). This is referred to as a stop and start action. To continue on switching gears to bring gear 92 into engagement with gear 95, the direction of gear 100 is changed again to allow the clutch 90 to come out of neutral, then the direction is changed one more time to move the gears 92, 94 and clutch 90 further along in direction 96. This brings gear 92 into engagement with gear 95. The actions to switch from neutral to engagement of gear 92 (or gear 94) with gear 95 is called a jogging action.

In a preferred embodiment the feed rollers 60 and metering rollers 78 are driven in a common direction during simplex or duplex media handling. That common direction changes during duplex printing, but is the same for the feed rollers 60 and metering rollers 78. Depending on the position of gears 92, 94, the drive rollers 44, 46, while engaged, rotate in either the same direction as the feed rollers 60/metering rollers 78 or in the opposite direction as the feed rollers 60/metering rollers 78. While the drive rollers 44,46 are engaged, one drive roller 44/46 always rotates in the same direction as the other drive roller 15 46/44. The specific gear linkages for the transmission 48 and linkage 84 may vary depending on the specific embodiment. For example the relative positioning and size of the simplex media handling system 14 and duplex media handling system 22 may vary, resulting in differing transmission 48 and linkage 84 embodiments.

Media Handling Operation

The media handling operations for simplex and duplex media recording are described with regard to FIGS. 5–10. For either simplex or duplex print recording, a media sheet M is lifted into contact with a pick roller 59. The top sheet M is picked from a stack of media sheets in an input tray 110. Excess sheets are retarded by a restraint pad system 112 (see FIG. 2, 3). Referring to FIGS. 2 and 5 the picked media sheet M is fed around feed rollers 60. The feed idlers 62 and pinch rollers 70, 71 press the media sheet to the feed and pick rollers 59, 60. The media sheet pushes the flip guides 64, 66 out of the media path as the media sheet moves along the feed rollers 60. Beyond the flip guides 64, 66 the media sheet moves along a first media path 114. The media path 114 spans a path from rollers sleds 68/pinch rollers 70 to the metering rollers 78 and into a print zone 116. The media sheet is moved between the feed rollers 60 and the rollers sleds 68/pinch rollers 70, under the upper guide 76 and onto the metering rollers 78. Pinch rollers 80 press the media sheet to the metering rollers 78. Both the metering rollers 78 and the feed rollers 60 are moving in a forward direction 117 during the first side printing operation. Eventually a trailing edge of the media sheet M passes beyond the feed rollers 60 so that the metering rollers 78 move the media sheet. Beyond the pinch rollers 80, the media sheet is moved along a platform 118 of the pivot mechanism 82. The print source 12 is located adjacent to the platform 118. The area between the platform 118 and the print source 12 is referred to herein as the print zone 120. The media sheet M is fed through the print zone 120 into an output region 122, which in some embodiments includes an output tray 124.

For simplex printing, the media sheet is released into the output region 122. After an estimated drying time, another media sheet may be picked and fed along the media path through the print zone for print recording. For duplex printing, the above operation occurs for first side printing. However, for duplex printing the trailing edge 124 of the media sheet M is not released during the first-side printing. Referring to FIG. 6, while the pinch roller 80 presses the trailing edge 124 of the media sheet M to the metering roller 78, the motion of the feed rollers 60 and metering rollers 78 ceases. The estimated drying time is allowed before the drive motor 16 reverses the rotational direction of the feed rollers 60 and metering rollers 78 to a direction 121 (see FIG. 7). The sensor 40, which also serves to indicate whether the duplex media handling system is installed, in one embodiment for a wet ink print recording system (e.g., inkjet print recording) is a humidity sensor. The sensor 40 detects the ambient humidity. Another sensor (not shown) detects ambient temperature. Controller 18 looks up an estimated drying time before allowing the media sheet to be moved for second side printing. In alternative embodiments separate sensors are used to determine humidity and whether the duplex media handling system is installed.

The determination of when to stop the metering rollers 78 with the media sheet trailing edge grasped is now described. The simplex media handling system 14 includes a media sensor 72 and flag 74 (see FIGS. 2 and 3). When the media sheet M is moved along the first media path 114 from the feed rollers 60 toward the metering rollers 78, the lead edge of the media sheet trips the flag 74. Once the trailing edge 124 passes beyond the flag, the flag 74 returns to its unbiased position. The sensor 72 indicates when the leading edge and trailing edge of the media sheet M have passed the flag 74. These indications are detected by the controller 18 which then determines when the trailing edge 124 of the media sheet M is at the pinch roller 80. At such time the controller 18 has the drive motor 16 discontinue rotation of the feed rollers 60 and metering rollers 78. After a programmed pause (e.g., to allow for first side drying), the controller 18, then signals to the drive motor 16 to reverse the rotational directions of the feed rollers 60 and metering rollers 78 to the reverse direction 121.

Figure 7:
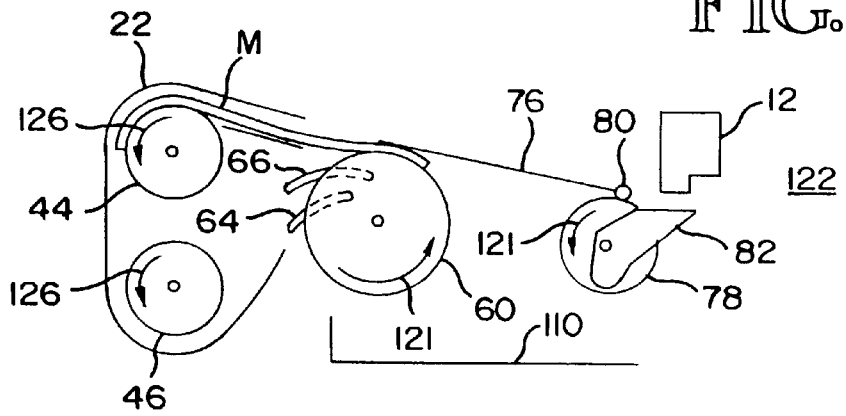
FIG. 7 is a diagram of the duplex media handling system and simplex media handing system where the media sheet is being fed back along the media path into the duplex media handling system.

Referring to FIG. 7, the metering rollers 78 feed the media sheet M back along the first media path 114 into contact with the feed rollers 60. The feed rollers 60 then continue feeding the media sheet back. Eventually the media sheet M is out of the grasp of the metering rollers 78 and fed back only by the feed rollers 60 (as distinguished from both the feed rollers 60 and metering rollers 78). As the media sheet M is fed back to and then onto the feed roller the flip guides 64, 66 are positioned in their unbiased position (see position in FIGS. 2 and 3). The unbiased position has the flip guides blocking the path around the feed rollers 60 back toward the input tray 110. Instead, the media sheet M is fed over a support surface of the flip guide 66 into the duplex media handling system module 22. The feed rollers 60 feed the media sheet M toward and onto the first drive roller 44. At the time where the controller 18 had the drive motor 16 reverse the directions of feed rollers 60 and metering rollers 78 to direction 121, such reversal action causes the transmission 48 to enter second gear (i.e., second gear 94 engages gear 95, see FIG. 4). As a result, when the media sheet is fed from the feed rollers 60 to the drive roller 44, the drive rollers 44, 46 are rotating in a direction 126. The drive roller 44 feeds the media sheet to drive roller 46. The drive rollers 44, 46, and then drive roller 46 alone feeds the media sheet along path 52 (see FIG. 3) back toward the feed rollers 60.

The duplex media handling system 22 has a media path length from entry point 54 to exit point 56 (see FIG. 3) which is at least as long as the maximum rated media sheet length for automatic duplex handling (e.g., 11 inches; 14 inches; 17 inches). If, however, automatic duplex handling is limited to a specific size, such as 11 inches or A4 paper length, then simplex printing (and manual duplex printing) may still print to larger sheets (e.g., 14 inches; 17 inches). Prior to the time the media sheet is fed out of the duplex media handling system 22 back onto the feed rollers 60, the feed rollers 60 are to change direction from reverse direction 121 back to the forward direction 117. However, the direction through the duplex media handling system module should stay the same (i.e., direction 126) even when the feed rollers 60 go back to the forward rotational direction 117. The forward rotational direction as used herein refers to the direction 117 which the feed rollers 60 rotate to move the media sheet from the feed rollers 60 to the metering rollers 78 along the first media path 114.

Figure 8:
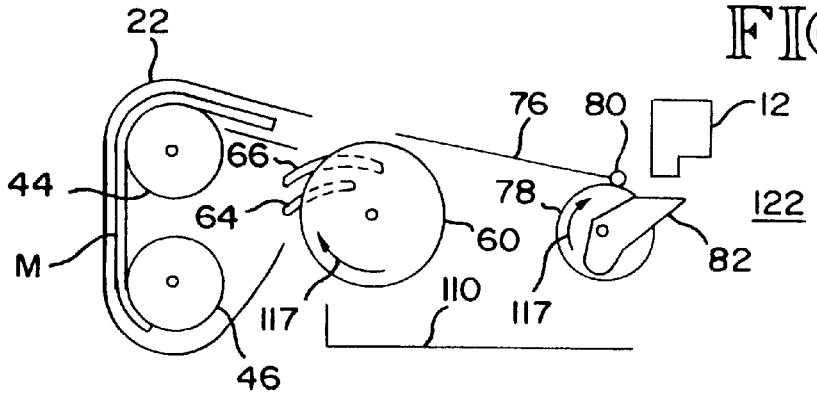
FIG. 8 is a diagram of the duplex media handling system and simplex media handing system where the media sheet is completely within the duplex media handling system and the feed rollers have reversed direction putting the transmission in neutral.
Figure 9:
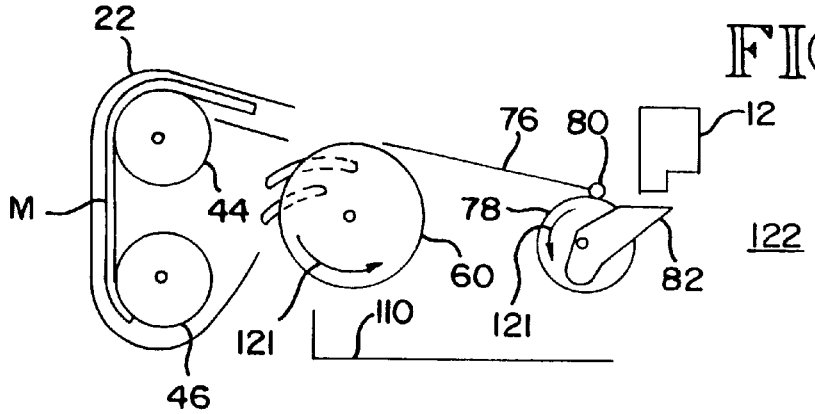
FIG. 9 is a diagram of the duplex media handling system and simplex media handing system during a jogging operation of the duplex media handling system transmission.
Figure 10:
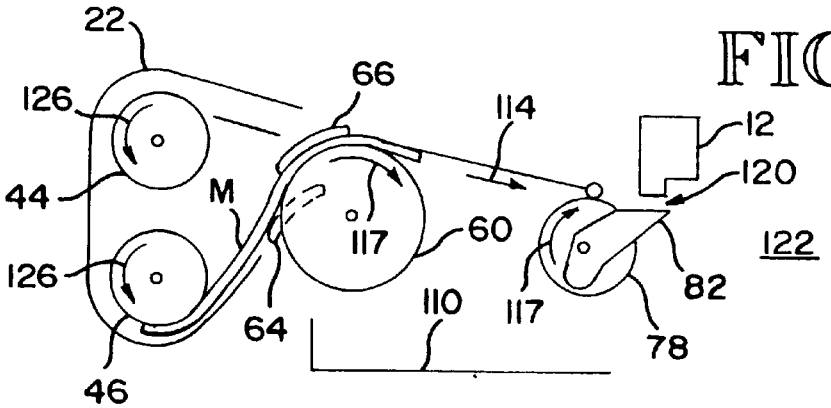
FIG. 10 is a diagram of the duplex media handling system and simplex media handing system during feeding of the media sheet from the duplex media handling system back to the simplex media handling system for second side print recording.

The process to change directions of the feed rollers 60 back to the forward direction 117, while the media sheet is in the duplex handling system 22, is now described. As the media sheet M is fed back along the first media path 114 from the metering rollers 78 to the feed rollers 60 (FIG. 7), the media sheet trips the secondary flag 75 which trips the flag 74 (see FIG. 3). The flag 74 is tripped, then released, as the entire media sheet passes beyond the flags 74, 75. The sensor 72 outputs such tripping indications to the controller 18. The controller knows what direction the drive motor 16 is rotating the rollers 60, 78, and thus 30 knows that the media sheet is being fed back for duplex printing. Thus, the controller 18 knows what signification to give to the trippings of the flag 74. Once the media sheet M has passed completely beyond the flag 72, the controller 18 waits a prescribed time (based upon path length and feed speed) until the media sheet is off the feed rollers 60 and pinch rollers 71 and is driven/fed only by the drive rollers 44 (or both drive roller sets 44,46). In particular, the controller 18 waits until the media sheet is a prescribed distance beyond the feed roller into the duplex media handling system 22. At such time, the controller 18 signals the drive motor 16 to change the rotational direction of the feed rollers 60 and metering rollers 78 back to the original forward direction 117. FIG. 8 shows the media sheet M in the duplex media handling system 22 with the feed rollers 60 restarted in the opposite direction. This stopping and starting action of the feed rollers 60 (and metering rollers 78) moves the clutch 90 (see FIG. 4) causing the second gear 94 to come out of mesh. Specifically, the stopping and starting action puts the transmission 48 into neutral.

To shift the transmission 48 out of neutral, and more particularly to engage the first gear 92, rather than the second gear 94, a jogging action is performed. Shortly after the drive motor changes the direction of the feed rollers 60 back to the forward direction 117, the drive motor 16 changes the direction again back to the reverse direction 121 (see FIG. 9), then forward again to direction 117 (see FIG. 10). This operation is referred to herein as a jogging action. Such jogging action causes the transmission 48 to engage the first gear 92 with gear 95 (see FIG. 4). With the first gear 92 engaged while the feed rollers 60 rotate in the forward direction, the drive rollers 44, 46 rotate in the desired direction 126 (see FIG. 10).

With the feed rollers 60 and metering rollers 78 rotating in direction 117 while the drive rollers 44, 46 rotating in direction 126, the media sheet M is fed out of the duplex media handling system 22 back onto the feed rollers 60. As a lead edge of the media sheet exits the duplex media handling system 22, such edge moves the flip guide 66 out of its path allowing the media sheet to be grasped by the feed rollers 60 and pinch rollers 71 and moved back onto the first media path 114 (see FIG. 10 and FIG. 5 for first media path 114). The media sheet M goes over the flip guide 64 and under the flip guide 66. The media sheet M is fed along the first media path 114 under the upper guide 76 for top of form sensing with sensor 72 and flags 74, 75, and onto the metering rollers 78 and the platform 118, into the print zone 120 for second side print recording. The media sheet M is fed through the print zone 120 into the output region 122. The media sheet then is released into the output region 122. After the estimated drying time, another media sheet may be picked and fed along the media path through the print zone for simplex or duplex print recording.

Method for Determining Drying Time

Figure 11:
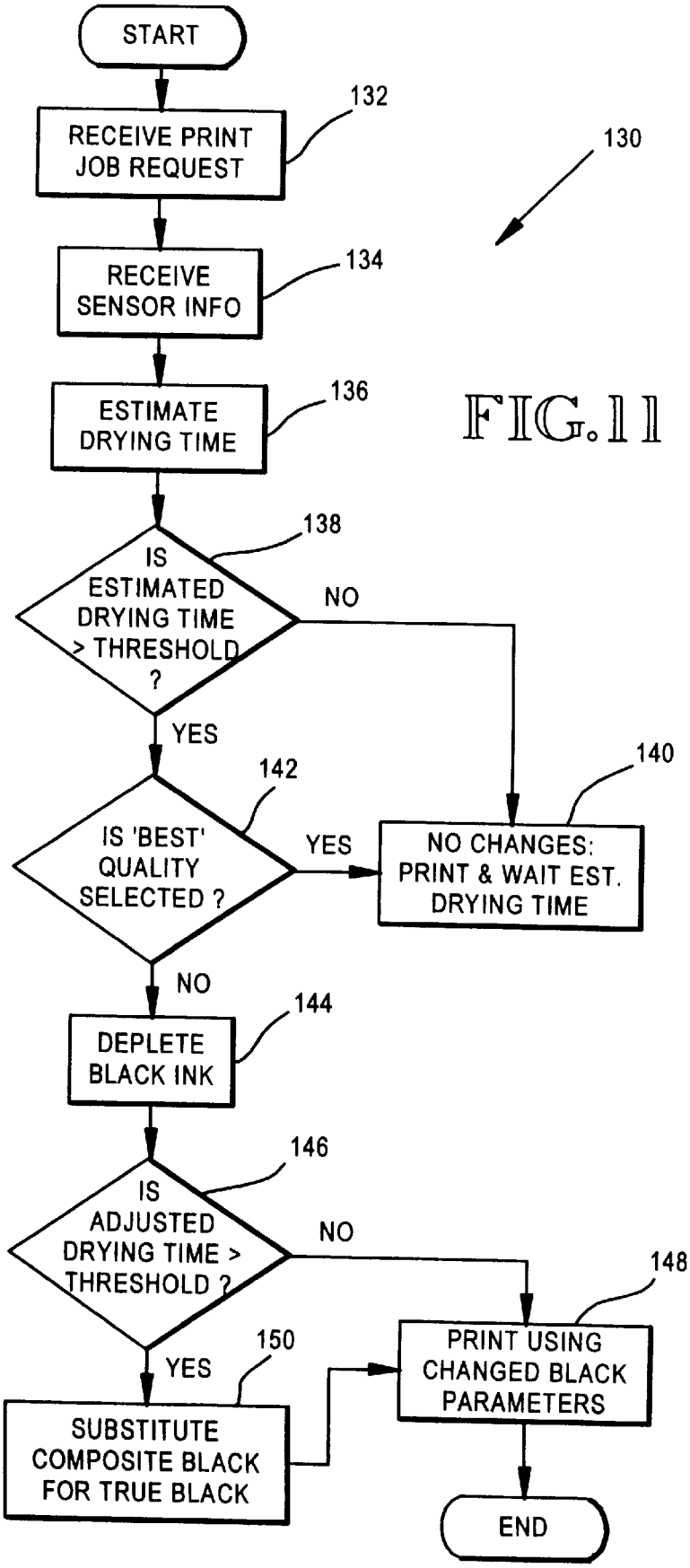
FIG. 11 is a flow chart of a method for estimating and adjusting media sheet drying time according to an embodiment of this invention.

Referring to FIG. 11, a flow chart 130 is shown for determining and adjusting drying time. Initially a print driver receives a command for a print job request. The print driver typically is a software program stored and executed on a host computer which controls communication with a printer 10. The printer controller 18 receives instructions at step 132 from the driver for executing the print job. Included with the print job request are parameters indicating the print quality for the print job. For example, various print qualities may include, draft mode, normal mode, and best mode. For a duplex printer, a parameter also is included as to whether to print the job in simplex mode (i.e., single-sided printing) or duplex mode (i.e., printing on each side). Additional information is the size of the print job (e.g., bytes and number of pages). In some embodiments there also is an indication of the media type, (e.g., normal copy paper; thick or card stock; transparency; glossy coated paper).

In a preferred embodiment the print job information is forwarded to the printer controller 18. Within the printer, at step 134 the controller 18 also receives information from one or more sensors. Included is a humidity sensor 40. In some embodiments there also is a temperature sensor which detects the ambient temperature. Also, in some embodiments an optical sensor is used to detect the media type. Sensing of the media type is performed in addition to, or instead of, a user selected media type parameter received with the print job request. Further in some embodiments an ink drop volume is identified. Typically ink drop volume is determined at a final stage of the printhead manufacturing process by expelling a drop of ink into a measurement device. Such volume is stored in printhead memory.

Based upon all these input values, plus the type of ink being used, how the ink is placed on the page (e.g., under printing, overprinting) and the density of ink on the page, an estimated drying time for a media sheet is determined. Thus, temperature, humidity, ink drop volume, amount of ink printed onto a given media sheet, the type of media sheet, the type of ink, how the ink is placed on the page (i.e., amount of under printing and overprinting), and the density of ink on the page determine the estimated drying time for the media sheet. For example, the lower the ambient temperature or the higher the ambient humidity, the longer it will take the media sheet to dry. The more ink applied to the media sheet (as determined by the ink drop volume and the size of the print job for the given media sheet or side of the media sheet), the longer it will take the media sheet to dry. Also, the less porous the media sheet, the longer it will take to dry. For example a transparency or a glossy sheet may longer to dry than a normal sheet of copy paper.

In one embodiment a table 19 of estimated drying time is prepared and stored in controller 18 memory or other memory of the printer or host computer. An entry is present for each combination of: media type, temperature, and humidity. The ink drop volume is fixed at the time of manufacture. The entry value is adjusted according to the size of the print job for the given media sheet (e.g., ink density for entire sheet; ink density within a subarea of the ink receiving portion of the sheet amount of ink per unit area within a given subarea). The values in the look-up table are derived empirically and stored in memory. At step 136 the estimated drying time is derived by looking up a value in the table and adjusting the value based on the ink density for the page side being printed. Alternatively, an algorithm is derived to fit the empirical data. In such embodiment the algorithm is stored in memory and executed at step 136 to estimate drying time.

At step 138 the estimated drying time is compared to a threshold value. In one embodiment such value is a fixed, predetermined value. In another embodiment, the value varies according to the size of the print job for the page side being printed. If the estimated drying time does not exceed the threshold time, then at step 140 printing occurs normally and the waiting time between printing sheets (or between printing a first side of a sheet and feeding the sheet back in for second side printing) is the estimated drying time.

If the estimated drying time does exceed the threshold time, then steps may be performed to reduce the estimated and actual drying times regardless of the print quality desired. However, in some embodiments the desired print quality is tested at step 142. If the print quality mode is "best," then the steps to reduce drying time are not performed. Instead, one just waits the estimated drying time as in step 140. When draft mode or normal quality mode are selected, then the drying time is reduced by an ink depletion process and/or an over-printing or under-printing process. When the best or highest quality print mode is selected, then drying time is reduced, or is not reduced, depending on the embodiment.

At step 144 the print commands are adjusted to reduce the amount of black pigment ink used in an image. When printing color images it is typical to form colors and various shades of colors by including a combination of pigment inks (e.g., CYMK). Various combinations may be used to form generally the same color. Conventionally, there is a percentage of black pigment ink used across the image for each desired image color to be perceived. By reducing this proportion of black pigment ink (a process referred to as depletion) the drying time is reduced. In some embodiments a new drying time is estimated allowing for black ink depletion. At step 146 such adjusted drying time is tested to determine if it is less than the threshold time. If so, then at step 148 printing occurs without further compensatory steps. If the adjusted drying time is greater than the threshold time, then additional steps are taken.

At step 150, the printing commands are adjusted to under-print or over-print black ink. In some printing systems there is a chemical reaction which occurs when black pigment ink mixes with a color (C, Y, or M) dye ink. The reaction causes the black pigment to fall out of solution on the page. Under printing is when color ink is placed on the page before the black ink. Over printing is when color ink is placed on the page after black ink. By placing them on the page at different times rather than at the same time, the pigment remains in solution. An attribute of under printing and over printing is to reduce smear sensitivity.

Black tones are formed using a black pigment ink. The color of black pigment ink is referred to as true black. Alternatively, black tones may be achieved by substituting composite black for all or a portion of the black pigment ink. Composite black is formed by combining colored dyes (e.g., cyan, magenta and yellow—CYM). The pigment black generates a truer black tone than the composite black. To reduce drying time the amount of pigment black and composite black may be altered to include more composite black and less pigment black for a desired black tone. In effect the true black is traded-off to decrease drying time, (i.e., how black the desired black tone appears is traded off to decrease the drying time). This is acceptable during draft or normal print quality modes.

Although the depletion step is described as being performed before the over-printing and under-printing step, in other embodiments it is omitted or performed after. In various embodiments only one process of the black depletion and over-printing/under-printing processes are performed. In other embodiments both processes are performed. In still other embodiments one is performed and the other is performed when additional reduction in drying time is needed.

Meritorious and Advantageous Effects

An advantage of the invention is that the waiting time between printing media sheets or between printing to alternate sides of the same media sheet is reduced. Rather than use a fixed "worst case" drying time, drying time is estimated for each media sheet or each side of a media sheet. In some embodiments the drying time is estimated as an average drying time per sheet (or side of a sheet). The average drying time is used for a corresponding print job. A new average is derived for each print job. Another advantage of this invention is that active steps are taken to reduce the required drying time by altering the print instructions for a graphic image.

Another advantage is that under printing black ink, although increasing ink density by increasing color dye ink volume printed, decreases drying time for porous optical media.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for printing a print job spanning a plurality of media sheets, the print job including print commands, the method comprising the steps of:

identifying a print job parameter for the print job;

sensing ambient humidity;

estimating a media sheet drying time from the identified print job parameter and sensed humidity;

reducing the estimated drying time by changing a plurality of print commands of the print job to reduce black pigment ink used for the print job;

printing to the media sheet using the changed plurality of print commands;

waiting for a time period before resuming printing, wherein the time period is based on the reduced estimated drying time.

2. The method of claim 1, in which the step of reducing comprises:

changing the plurality of print commands of the print job to deplete an amount of black pigment ink used.

3. The method of claim 1, in which the step of reducing comprises:

changing the plurality of print commands of the print job to alter printing of a black tone by under printing black pigment ink.

4. The method of claim 1, in which the step of reducing comprises:

changing the plurality of print commands of the print job to alter printing of a black tone by decreasing a proportion of black pigment ink to include a composite black from a plurality of colored dye inks.

5. The method of claim 1, in which the step of reducing comprises:

changing the plurality of print commands of the print job to alter printing of a black tone by printing a composite black from a plurality of colored dye inks in place of a true black from the black pigment ink.

6. The method of claim 1, in which the step of identifying a print job parameter comprises identifying a type of media sheet for the print job.

7. The method of claim 1, in which the step of identifying a print job parameter comprises identifying a print quality mode for the print job as being other than a highest quality printing mode.

8. The method of claim 1, in which the step of identifying a print job parameter comprises identifying a media handling mode as duplex media handling, wherein the step of printing is for printing to a first side of the media sheet, and wherein the step of waiting comprises waiting for the time period before printing to a second side of the media sheet.

9. The method of claim 1, further comprising the step of sensing ambient temperature and wherein the step of estimating comprises estimating the media sheet drying time from the identified print job parameter, sensed humidity and sensed temperature.

10. The method of claim 1, in which the step of identifying comprises identifying a plurality of print job parameters including type of media sheet and size of the print job.

11. An apparatus for printing a print job spanning a plurality of media sheets, the print job including print commands, the apparatus comprising:

means for identifying a print job parameter for the print job;

a sensor which detects ambient humidity;

means for estimating a media sheet drying time from the identified print job parameter and sensed humidity;

a controller which reduces the estimated drying time by changing a plurality of print commands of the print job, wherein the print commands reduce black pigment ink used for the print job to achieve an adjusted drying time;

a media handling system which moves the media sheet along a media path into a position to receive print;

an inkjet pen which prints to the media sheet using the changed plurality of print commands, wherein the controller controls the media handling system to allow a time period before printing to another media sheet, wherein the time period is based on the adjusted drying time.

12. The apparatus of claim 11, in which the controller reduces the estimated drying time to achieve an adjusted drying time by changing the plurality of print commands of the print job causing a depletion of an amount of black pigment ink used through an image being printed.

13. The apparatus of claim 11, in which the controller reduces the estimated drying time to achieve an adjusted drying time by changing the plurality of print commands of the print job to alter printing of a black tone by under printing a black pigment ink.

14. The apparatus of claim 11, in which the controller reduces the estimated drying time to achieve an adjusted drying time by changing the plurality of print commands of the print job to alter printing of a black tone by printing a composite black from a plurality of colored dye inks in place of printing a true black from a black pigment ink.

15. The apparatus of claim 11, in which the controller reduces the estimated drying time to achieve an adjusted drying time by changing the plurality of print commands of the print job to alter printing of a black tone by decreasing a proportion of black pigment ink to include a composite black from a plurality of colored dye inks.

16. The apparatus of claim 11, in which the identifying means identifies a type of media sheet as the print job parameter.

17. The apparatus of claim 11, in which the identifying means identifies the print job parameter as a print quality mode which is less than a best quality printing mode.

18. The apparatus of claim 11, in which the identifying means identifies the print job parameter as a duplex media handling mode, and wherein the step of printing is for printing to a first side of the media sheet, and wherein the controller controls the media handling system to allow a time period before printing to a second side of the media sheet.

19. The apparatus of claim 11, further comprising a sensor which detects the ambient temperature and wherein the estimating means estimates drying time from the identified print job parameter, sensed humidity and sensed temperature.

20. The apparatus of claim 11, in which the identifying means identifies a plurality of print job parameters including type of media sheet and size of the print job.

21. A method for printing a print job spanning a plurality of media sheets, the print job including print commands, the method comprising the steps of:

identifying a print job parameter for the print job;

sensing ambient humidity;

determining an estimated drying time for a media sheet based upon the identified print job parameter and sensed humidity;

comparing the estimated drying time to a threshold drying time;

when the estimated drying time exceeds the threshold drying time, reducing the estimated drying time by changing a plurality of print commands for the media sheet to reduce black pigment ink used for the media sheet, and printing to the media sheet using the changed plurality of print commands;

when the estimated drying time does not exceed the threshold drying time, printing to the media sheet without reducing the black pigment ink used for the media sheet; and waiting for a time period before resuming printing, wherein the time period is based on one of either the determined estimated drying time or the reduced estimated drying time.

22. The method of claim 21, wherein the step of determining comprises looking up the estimated drying time in a look-up table.

23. The apparatus of claim 11, wherein the controller comprises means for comparing the estimated drying time to a threshold drying time, wherein the controller reduces the estimated drying time when the estimated drying time exceeds the threshold drying time, and does not reduce the estimated drying time when the estimated drying time is less than the threshold drying time.

24. The apparatus of claim 11, wherein the estimating means comprises a look-up table.

* * * * *